US011786005B2

(12) United States Patent
Kerr et al.

(10) Patent No.: US 11,786,005 B2
(45) Date of Patent: Oct. 17, 2023

(54) WATERSPORT BOOT

(71) Applicant: Zhik Pty Ltd., Artarmon (AU)

(72) Inventors: Andrue Kerr, Artarmon (AU); Bartosz Milczarczyk, Artarmon (AU)

(73) Assignee: Zhik Pty Ltd, Artarmon (AU)

( * ) Notice: Subject to any disclaimer, the term of this patent is extended or adjusted under 35 U.S.C. 154(b) by 0 days.

(21) Appl. No.: 16/411,661

(22) Filed: May 14, 2019

(65) Prior Publication Data

US 2019/0350305 A1 Nov. 21, 2019

(30) Foreign Application Priority Data

May 15, 2018 (AU) ..... 2018901693

(51) Int. Cl.

| | |
|---|---|
| ***A43B 5/08*** | (2006.01) |
| ***A43B 1/10*** | (2006.01) |
| ***A43B 23/02*** | (2006.01) |
| ***A43C 1/02*** | (2006.01) |
| ***A43C 11/00*** | (2006.01) |
| ***A43C 7/02*** | (2006.01) |

(52) U.S. Cl.

CPC ..... *A43B 5/08* (2013.01); *A43B 1/10* (2013.01); *A43B 23/026* (2013.01); *A43C 1/02* (2013.01); *A43C 7/02* (2013.01); *A43C 11/004* (2013.01)

(58) Field of Classification Search

None

See application file for complete search history.

(56) References Cited

U.S. PATENT DOCUMENTS

| | | | | | |
|---|---|---|---|---|---|
| 1,256,254 | A * | 2/1918 | Peterson | A43C 7/00 | 24/713 |
| 3,275,002 | A * | 9/1966 | Scholl | A43B 7/1495 | 36/140 |
| 3,703,775 | A * | 11/1972 | Gatti | A43B 5/02 | 36/50.1 |
| 4,217,706 | A * | 8/1980 | Vartanian | A43C 11/008 | 36/110 |
| 4,616,432 | A * | 10/1986 | Bunch | A43C 1/003 | 36/114 |
| 5,408,761 | A * | 4/1995 | Gazzano | A43B 5/00 | 36/102 |
| 5,471,769 | A * | 12/1995 | Sink | A43B 11/00 | 24/712.1 |
| 6,922,917 | B2 * | 8/2005 | Kerns | A43B 5/14 | 36/50.1 |

(Continued)

FOREIGN PATENT DOCUMENTS

| | | | | |
|---|---|---|---|---|
| GB | 2 433 411 | | 6/2007 | |
| GB | 2436726 A | * | 10/2007 | A43B 5/08 |

*Primary Examiner* — Jila M Mohandesi

(74) *Attorney, Agent, or Firm* — Nixon & Vanderhye P.C.

(57) ABSTRACT

A footwear article for watersports comprising a sole, a vamp in connection with the sole and an upper fixed with the vamp and the sole. A lacing system disposed on the upper, the lacing system comprises a lace, a first set of anchor points and a second set of anchor points. Said lacing system is disposed on an outer side of the upper and configured such that the lace crosses over itself fewer than six times between anchor points in the closed configuration; and wherein at least one of the vamp and the upper comprises a textured surface, and an upper comprises a strap adapted to extend around at least the perimeter of the upper.

21 Claims, 7 Drawing Sheets

(56) References Cited

U.S. PATENT DOCUMENTS

| | | | | |
|---|---|---|---|---|
| D664,259 | S * | 7/2012 | Joseph | A43B 5/14 D24/192 |
| 8,230,617 | B2 * | 7/2012 | Luedecke | A43B 5/08 36/8.1 |
| 8,726,540 | B2 * | 5/2014 | Crowley, II | A43B 1/0009 36/8.1 |
| 8,943,711 | B2 * | 2/2015 | Hooper | A43B 5/025 36/133 |
| 9,526,296 | B2 * | 12/2016 | Langvin | A43B 5/00 |
| 9,642,418 | B2 * | 5/2017 | Kopcienski | A43C 11/24 |
| 2008/0016717 | A1 * | 1/2008 | Ruban | A43B 23/022 36/21 |
| 2009/0083996 | A1 * | 4/2009 | Clancy | A43C 15/00 36/88 |
| 2011/0088283 | A1 * | 4/2011 | Berthet | A43B 5/0411 36/50.1 |
| 2013/0174391 | A1 * | 7/2013 | Neale | A43C 1/00 24/712.9 |
| 2015/0257476 | A1 * | 9/2015 | Panian | A43B 13/22 36/114 |
| 2015/0359296 | A1 * | 12/2015 | Gulla | A43C 7/005 36/109 |
| 2016/0270484 | A1 * | 9/2016 | Zadnik | A43C 11/00 |
| 2018/0242692 | A1 * | 8/2018 | Houng | A43C 11/1493 |

* cited by examiner

WATERSPORT BOOT

This application claims priority to AU 2018901693 filed May 15, 2018, the entire contents of each of which is hereby incorporated by reference.

TECHNICAL FIELD

The present disclosure relates to a sportswear boot. More specifically, the present disclosure relates to a boot suitable for watersport activities.

BACKGROUND

Watersport boots are generally formed similar to neoprene diving boots, adapted for other watersport applications by surface modifications. As these boots are primarily used for a diving application, there are a number of problems for use with non-diving applications. Generally these boots have no considerations or additions for working with other watersports equipment, such as a hiking strap, boot strap or other interface commonly encountered on a sailing vessel or other watersport vessel.

Boots adapted from diving boots commonly utilise a zipper or hook and loop strap closure to fasten the boot around the foot or ankle of a user. These zipper closures generally do not provide adequate tightening of the footwear around the foot or ankle of the user which limits the amount of feel and control that the user has on the watersport vessel.

A known watersport boot is disclosed in Conolly, UK Patent GB 2,433,411 ('411), whereby a lacing system is provided on the side of the watersport boot, which can provide a more adequate means of tightening a boot around the foot and ankle of a user. However, there are a number of problems with this boot. Notably, the boot does not allow the lacing area to compress and reduce the volume of the boot significantly when tightened therefore limiting the boots ability to fit tightly around some feet and ankles of the user.

A known watersports boot is illustrated in FIGS. 1A to 1D. The boot is shown with a side lacing system 10 that features an expandable gusset panel 11 within the lacing area of the boot.

While known boots, such as the boots disclosed in '411, provide for a more comfortable watersports boot relative to modified diving boots, there are a number of known comfort issues and performance issues with the known boots. As such, it may be advantageous to provide for a boot which overcomes at least one problem associated with known boots.

Other attempts have been made for watersport boots, however these boots are generally uncomfortable for prolonged use, or are inadequate for watersport use. More particularly, the known boots have complex securing systems to secure the boot to the foot of a user.

Any discussion of the prior art throughout the specification should in no way be considered as an admission that such prior art is widely known or forms part of common general knowledge in the field.

SUMMARY

Problems to be Solved

It may be advantageous to provide for a boot which provide with an improved comfort in use.

It may be advantageous to provide for footwear which can be used for watersports, such as sailing.

It may be advantageous to provide for a wearable foot support, suitable for sporting.

It may be advantageous to provide for a boot suitable for watersports which can be more readily donned and doffed.

It may be advantageous to provide for a watersport boot which can allow for faster lacing.

It may be advantageous to provide for a lace system which is easier to manipulate, relative to known systems.

It may be advantageous to provide for an upper which is more comfortable around an ankle of a user during use.

It may be advantageous to provide for a boat with a gusset which lies substantially flush when in use.

It is an object of the present invention to overcome or ameliorate at least one of the disadvantages of the prior art, or to provide a useful alternative.

Means for Solving the Problem

A first aspect of the present invention may relate to a footwear article for watersports. The boot comprises a sole, a vamp in connection with the sole and an upper fixed with the vamp and the sole. A lacing system disposed on the upper, the lacing system comprises a lace, a first set of anchor points and a second set of anchor points. Said lacing system is disposed on an outer side of the upper and configured such that the lace crosses over itself fewer than six times between anchor points in the closed configuration; and wherein at least one of the vamp and the upper comprises a textured surface, and an upper comprises a strap adapted to extend around at least the perimeter of the upper.

Preferably, the upper may be integrally formed with the vamp. Preferably, the textured surface comprises a plurality of protrusions and may be adapted to mate with a hiking strap. Preferably, the sole comprises at least one of; an outsole, a midsole and an insole. Preferably, at least one rubber layer may be fixed to at least one of the vamp and the upper. Preferably, the strap may comprise a securing means such that the strap can be secured around the perimeter of the upper. Preferably, the upper may be formed with a strap guide. Preferably, the article may be formed in part with at least one material selected from the following group; an open cell composite, a closed cell composite, a foam, a rubber and a combination of one of the preceding materials. Preferably, the rubber may be a natural and/or synthetic rubber.

Another aspect of the present invention may relate to a footwear article comprising a sole connected to an upper forming a boot. The upper defining an opening into a cavity of the boot for receiving a foot of a user. A top surface of the boot comprising a textured surface; and wherein a strap is mounted on the upper, in which the strap is adapted to extend around at least the perimeter of the upper.

Preferably, the opening of the upper can be expanded to receive said foot of the user. Preferably, the footwear article may comprise a lace system disposed on the upper. Preferably, the lace system comprises a lace formed from at least one elastomeric fibre. Preferably, the lace system comprises a first set of tensioning points on a first segment of the upper, and a second set of tensioning points on a second segment of the upper. Preferably, the upper may be covered at least in part with a rubber layer. Preferably, the upper may be formed with a strap guide.

In the context of the present invention, the words "comprise", "comprising" and the like are to be construed in their inclusive, as opposed to their exclusive, sense, that is in the sense of "including, but not limited to".

The invention is to be interpreted with reference to the at least one of the technical problems described or affiliated with the background art. The present aims to solve or ameliorate at least one of the technical problems and this may result in one or more advantageous effects as defined by this specification and described in detail with reference to the preferred embodiments of the present invention.

DESCRIPTION OF THE INVENTION

Preferred embodiments of the invention will now be described with reference to the accompanying drawings and non-limiting examples.

FEATURES

1—Boot
2—Inner side of boot
3—Outer side of boot
5—Toe end
7—Heel end
10—Side lacing system
11—Expandable Gusset
15—Lace system
16—Upper
18—Vamp
19—Opening
20—Split
21—Front segment
22—Rear segment
23—Lace
24—Tensioning points
25—Corresponding tensioning points
26—Gusset
27—Attachment edge
28—Attachment point
29—Cord lock
30—Rubber (overlays)
32—Textured surface
33—Heel cup/rubber layers
34—Ankle strap
36—Ankle strap guide
40—Pull strap
42—Sole
44—Outsole
46—Midsole
48—Insole
50—Collar The present disclosure is directed towards boots 1 for use in water, particularly boots for watersports, which may have particular utility in sailing. These boots 1 are generally worn for an extended period of time and are required to provide a suitable level of comfort to the wearer, while also providing the wearer with a level of support and means to allow water to be expelled to drain from the boot 1 while in use to keep the feet of the user as dry as possible.

Figure 1A:
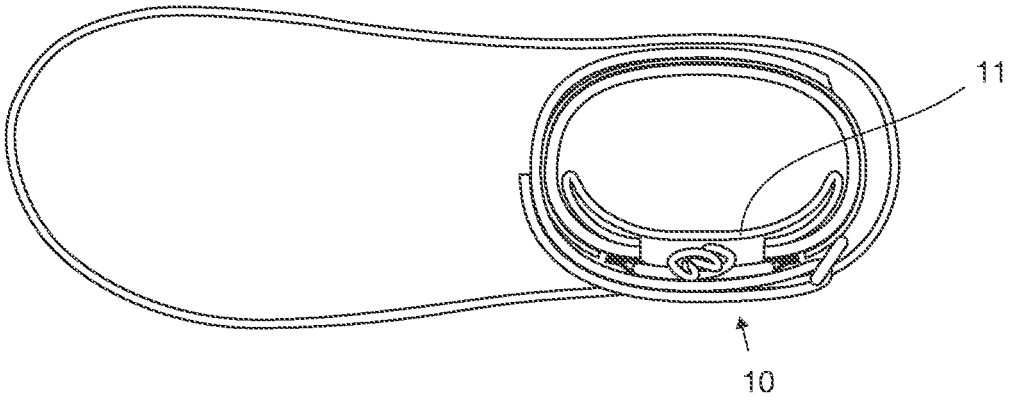
FIG. 1A PRIOR ART
FIG. 1A (Prior Art) illustrates a top view of an embodiment of a boot forming part of the prior art.
Figure 1B:
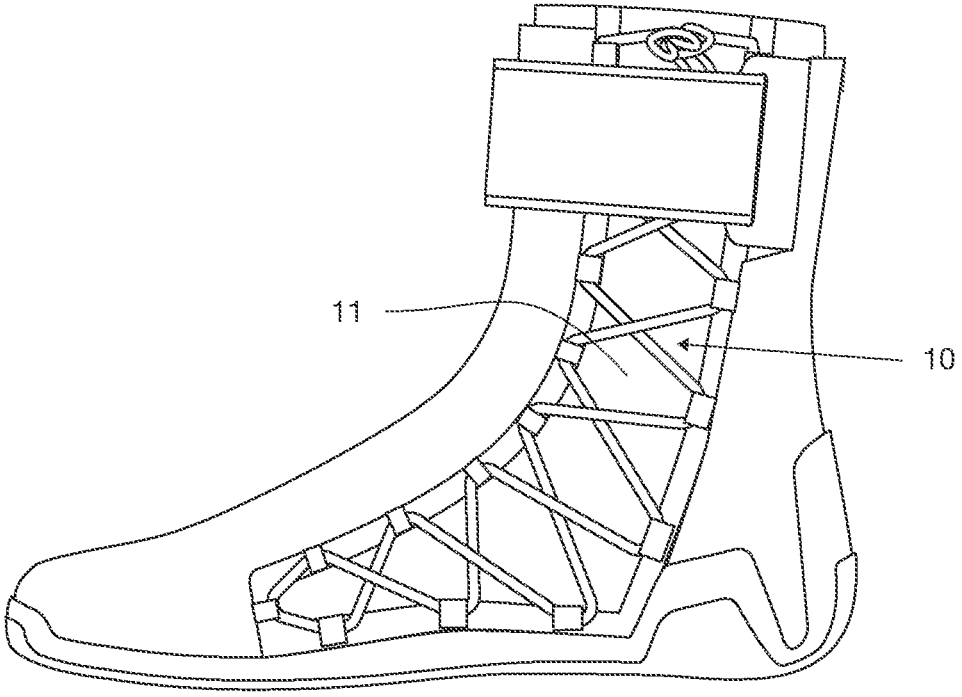
FIG. 1B PRIOR ART
FIG. 1B (Prior Art) illustrates a side view of a prior art boot in a closed configuration.
Figure 1C:
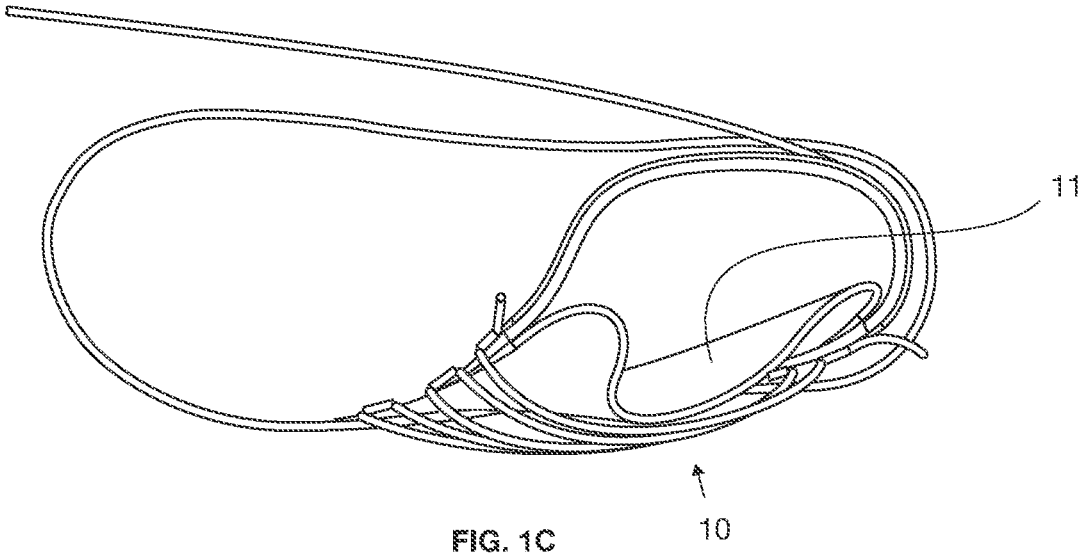
FIG. 1C PRIOR ART
FIG. 1C (Prior Art) illustrates a top view of the boot of FIG. 1A in an open configuration.
Figure 1D:
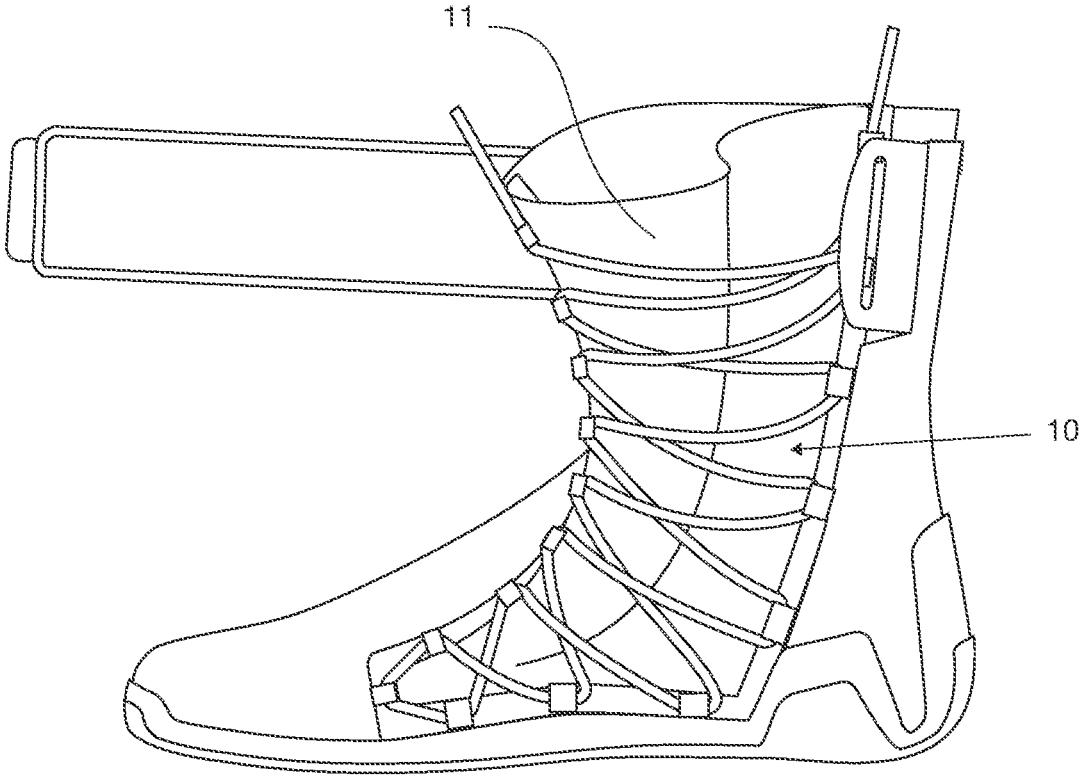
FIG. 1D PRIOR ART
FIG. 1D (Prior Art) illustrates a side view of the boot of FIG. 1B in an open configuration.
Figure 2A:
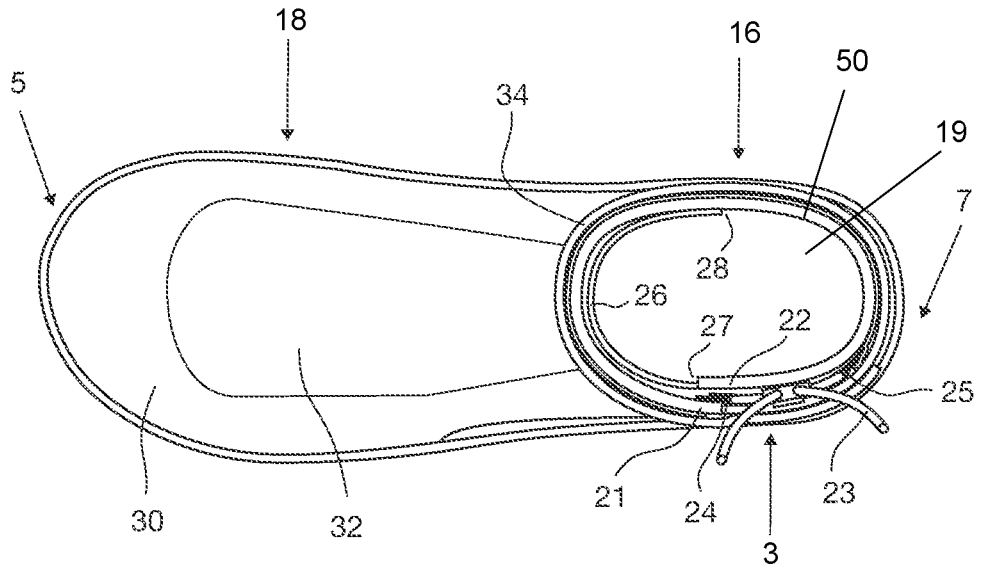
FIG. 2A illustrates top view of an embodiment of a boot in a closed configuration with a textured vamp surface.
Figure 2B:
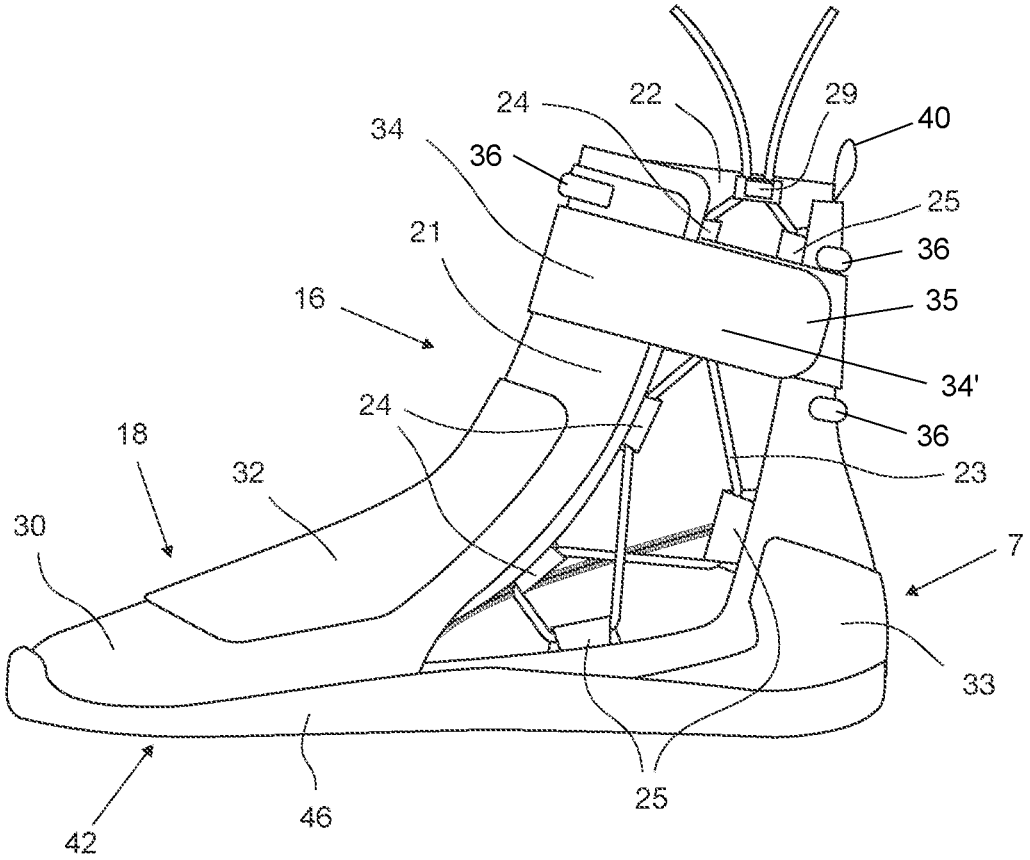
FIG. 2B illustrates a side view of an embodiment of the boot of FIG. 2A.
Figure 3A:
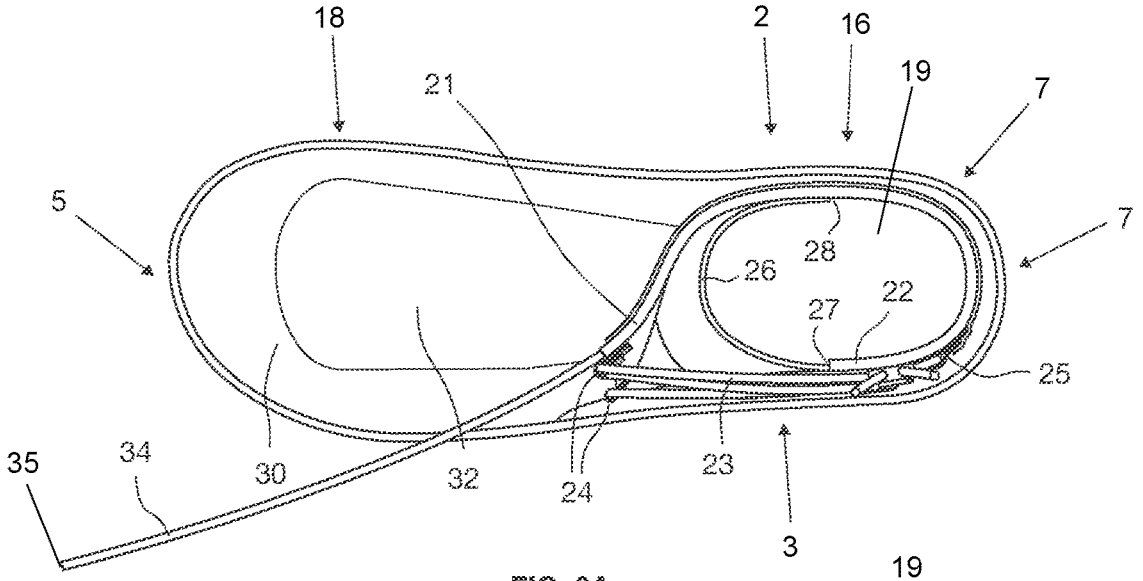
FIG. 3A illustrates an embodiment of a top view of the boot of FIG. 2A in an open configuration.
Figure 3B:
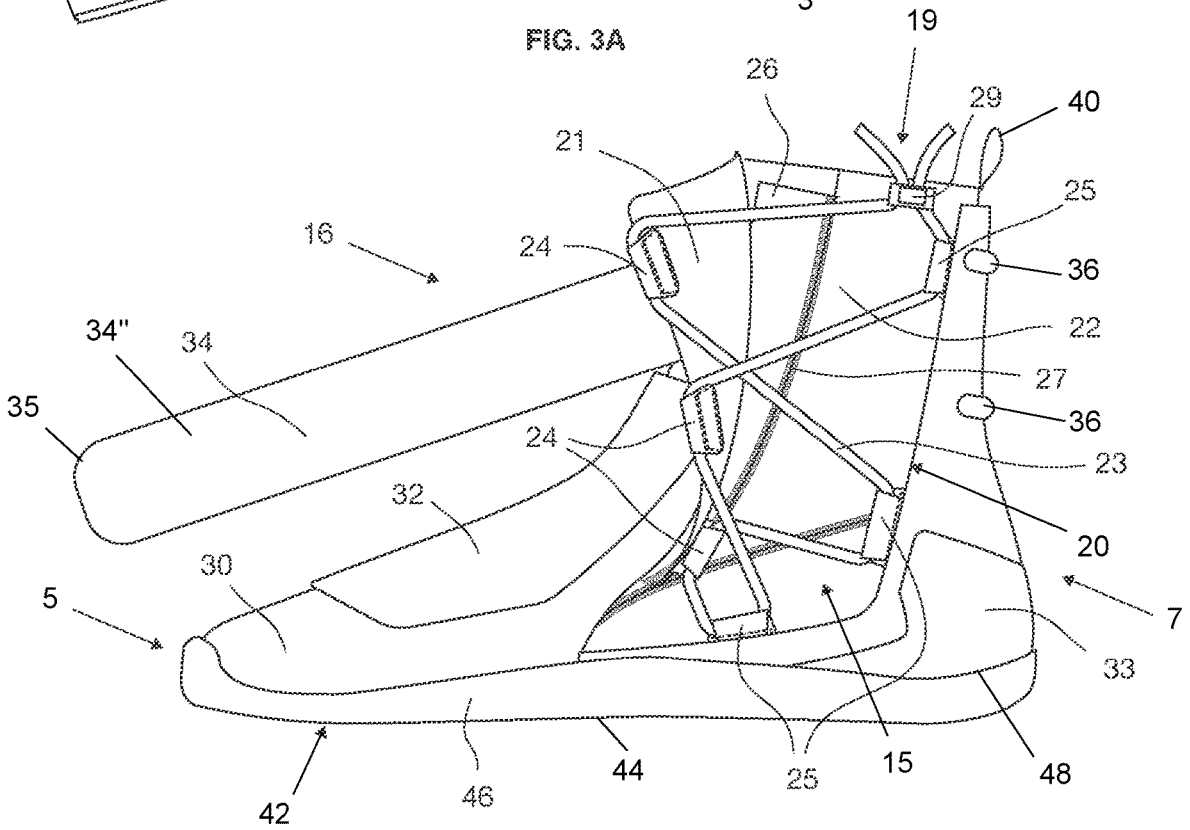
FIG. 3B illustrates a side view an embodiment of FIG. 3A, in which the boot is in an open configuration.

FIGS. 2A and 2B show top view and a side view of an embodiment of a boot 1 suitable for watersports and sailing. The boot 1 is shown in a closed or 'laced' position (also referred to as a closed configuration), and FIGS. 3A and 3B show the boot of FIGS. 3A and 3B in an open 'un-laced' position (also referred to as an open configuration).

The boot 1 has an upper 16, a vamp 18, and a sole 42. The vamp 18 is at the toe end 5 of the boot, and the upper 16 is at the heel end 7 of the boot 1. The upper 16 is formed with an opening 19 near to the top of the boot 1 with the opening 19 being defined by a gusset 26 and the rear segment 22 of the upper 16. A collar 50 (or topline) of the upper 16 is defined by front segment 21 and rear segment 22 of the upper 16. The upper 16 is formed with a front segment 21 and a rear segment 22, with the front segment 21 and rear segment 22 being separable in the axial direction of the upper 16. Front segment 21 may be referred to herein as front segment 21, and the rear segment 22 may be referred to herein as rear segment 22. A lacing system 15, comprising a lace 23, and tensioning points 24, 25, connects front segment 21 to rear segment 22. The tensioning point 24, 25 may be lace loops and can be connected to the front segment 21 and rear segment 22 respectively. Front segment 21 may be adapted to overlap at least a portion of rear segment 22 when lace 23 is tightened. Tightening the laces 23 can reduce the volume of the boot upper 16 allow it to fit more snugly or more tightly around a foot and/or ankle of the user.

Optionally, a cord lock 29 or other lace securing means 29 can be provided to lock or retain the lace 23 in a desired configuration when said lace is tightened. In another embodiments the lace 23 may be secured by tying a knot or other method known in the art. The cord lock 29 may be fixed or releasably attached to the boot 1 near to the opening 19 of the upper 16, and the cord lock 29 being movable relative to the opening 19.

The boot upper 16 may be formed with any desired textile, but is preferably formed from a textile of at least one of; an open cell foam composite or closed cell foam composite, or a combination thereof. Suitable textiles may also include, or alternatively be, knitted, woven or non-woven textiles comprised of natural or synthetic yarns. Suitable open or closed cell foams may include polyurethane foams, EVA foams, neoprene foams, styrene butadiene rubber foams or other foams and are preferably laminated on one or both sides to a knitted or woven textile comprising natural or synthetic yarns.

In another embodiment, the upper 16 is made from a warp knitted mesh textile. In another embodiment, the said upper 16 is made from a neoprene and/or circular knitted textile composite. The upper 16 materials may be selected to provide stretchability in at least in one plane to allow the upper 16 to conform or substantially conform to the anatomy of a user.

In another embodiment, the boot 1 may be formed from a textile or textile and foam composite upper 16 combined with a natural or synthetic rubber outer layer. The rubber is preferably in the range of 0.5 mm to 5 mm thick, but more preferably in the range of 1 mm to 2 mm thick, and is applied to the upper 16 using a suitable vulcanisation process. The boot 1 can comprise an outer layer of rubber 30 covering substantially the external surface of the upper 16, vamp 18 and the sole 42 of the boot 1. The boot 1 may feature additional rubber layers 30 or armour layers to provide at least one of; increased rigidity, support, grip, durability or protection or may exclude rubber from some areas to provide improved flexibility or breathability. For example, the toe tip of the boot 1 may be provided with less material to allow for sailors to feel when their foot is under a rope or an obstacle. A textured rubber surface 32 may be provided on the vamp 18 of the boot 1 to provide for a contact surface for connection with hiking straps for hiking from the gunnels of a sailing vessel. The textured surface 32 of the boot 1 may be used to mate with a hiking strap, and may be formed with a plurality of protrusions. In another preferred embodiment, a heel cup 33, rubber layer 30 or armour layer is provided to provide additional support and may assist with protecting the foot of the user.

The sole 42 of the boot 1 is preferably textured to provide grip and allow water to be expelled from the boot 1 when standing on wet surfaces. The sole 42 may be formed from natural or synthetic rubber or a combination thereof. Sole 42 is preferably formed from any material with a high level of grip on wet surfaces, or more generally has a high friction coefficient. The sole 42 may be vulcanised prior to being fixed to the boot 1 or combined with the boot 1 along with other panels prior to vulcanisation. Channels may be provided to allow water to be expelled from the boot. Optionally, the gusset 26 can allow for drainage via split 20. The split 20 may be formed as any desired shape, and may be abstractly angled to conform to the shape of the foot of the wearer. More than one split angle may be provided to impart a desired flexure or bending to the boot 1, when in use. The upper preferably has a portion of the rear segment 22, front segment 21 and/or under the gusset 26 positioned under to the split 20 (between the materials that forms the split and the foot of the wearer), which may be a barrier to protect the foot or ankle of the wearer.

In a further embodiment, a gusset 26 is provided that connects at one end to the edge of the split at attachment edge 27 and at another end to the inner surface of the boot 1 at attachment point 28. Optionally, the gusset 26 is not connected to the upper 16 at attachment point 28 and is free as one end, and may be formed from the same material as that of the rear segment 22. The gusset 26 may be an elastic stretchable gusset 26 and may be configured such that it does not gather or overlap itself when the boot 1 is a closed configuration, or a configuration which defines the tightest configuration, as is common in the art. The material for the gusset 26 is selected so that it may elongate to allow an opening 19 created between the gusset 26 and rear segment 22 to expand adequately and allow the user to don and doff the boot 1 relatively easily.

The gusset 26 is provided to hold the boot upper 16 tightly on the foot of a user prior to tightening the lacing laces 23 of the lacing system 15. The gusset 26 also assists in the positioning of the upper 16 on a last during manufacturing without the use of the lace 23 thereby reducing time required to fit the front segment 21 and rear segment 22 of the upper 16 on a last and improving consistency during mass production.

The gusset 26 is preferably configured to be wide enough to allow expansion of the opening 19 to allow for a wearer to don and doff the boot. The collar 50 of the upper 16 can be padded or reinforced to provide for a more comfortable fit and provide for a tighter abutment between an ankle of the user and the boot. Preferably, the gusset 26 material is stretchable with enough stretch such that the overall gusset 26 size can be minimised. If a less stretchable gusset 26 material is used, then a wider gusset 26 must be used to allow adequate expansion of the opening to allow the user to enter and remove their foot from the boot. The use of a wider gusset 26 requires the attachment edge 28 of the gusset 26 to be positioned further round the circumference (perimeter) of the upper 16 from attachment edge 27 to ensure that the gusset 26 rests substantially flat around the ankle or foot of a user when the boot 1 is tightened.

The gusset 26 may be configured to have more than 50% elongation or expansion ability and its size and position can be configured such that the elongation of the gusset 26 allows the opening to expand to at least 125% of the closed perimeter length. In another embodiment the gusset 26 is configured to have more than 100% elongation ability and its size and position is configured so that the elongation of the gusset 26 allows the opening to expand to at least 150% of the closed opening perimeter length. In one embodiment, the gusset 26 can stretch or elongate in at least one plane between 100% to 400%.

The gusset 26 may be formed from a stretchable textile which is preferably open cell foam composite or closed cell foam composite, or a combination thereof. Suitable textiles may include knitted or woven textiles comprised of natural or synthetic yarns. In one preferred embodiment said upper 16 is made from a warp knitted mesh textile. Suitable open cell foam or closed cell foams may be selected from the following group; polyurethane foams, EVA foams, neoprene foams, styrene butadiene rubber foams or other foams and are preferably lamination to knitted or woven textiles comprises of natural or synthetic yarns on one for both surfaces of the foam. The gusset 26 can have at least 50% elongation before failure along the axis to which is elongated when to boot opening 19 is expanded. In a preferred embodiment, the gusset 26 is formed from a warp knitted or circular knitted textiles comprising elastane and other synthetic yarns with and elongation of more 100% or more before tensile failure.

In yet another embodiment, the watersports boot 1 also comprises an ankle strap 34 featuring a hook and loop fastener or another predetermined fastener. The ankle strap 34 is preferably fixed at one end to the upper 16 and configured to wrap around the boot 1 and fasten onto itself or an attachment point. The ankle strap 34 may be configured with a buckle, hook and loop fasteners or other suitable fastening means.

Tensioning points 24, 25 may be referred to as tensioning points 24 and corresponding tensioning points 25 and may be formed from a range of materials known in the art. Tensioning points 24, 25 may alternatively be in the form of eyelets, eyerows or any other suitable means to retain a lace 23 or cord 23. Lace loops 24, 25 may be formed from polyester or nylon webbing, neoprene, or a reinforced textile which allows for tension to be imparted to the lace loop repeatedly. The lace loops 24, 25 may include, but are not limited to, woven or knitted webbing stitched to the upper, plastic or metal loops, eyelets or other materials with stitched or punched holes. Tensioning points 24, 25 (or anchor points) may be formed from a Hypalon material, synthetic rubber, or similar material that is folded and stitched to the upper 16 to create loops, this embodiment is preferable as the Hypalon forms a strong bond to the rubber outer materials during vulcanisation.

FIGS. 4A to 5B show embodiments of a side view and top view of an upper with rubber layers 30, 33, outsole 44 and ankle strap 34 hidden to illustrate the interior layers of the boot 1. FIG. 3A shows the upper 16 in a closed 'laced' position, FIGS. 3A and 3B shows the upper 16 in the open configuration.

Figure 6A:
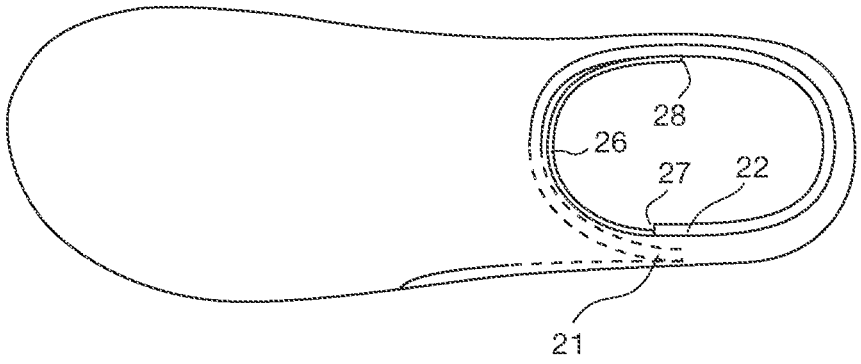
FIG. 6A illustrates a top view of an embodiment of a boot without a lace system.
Figure 6B:
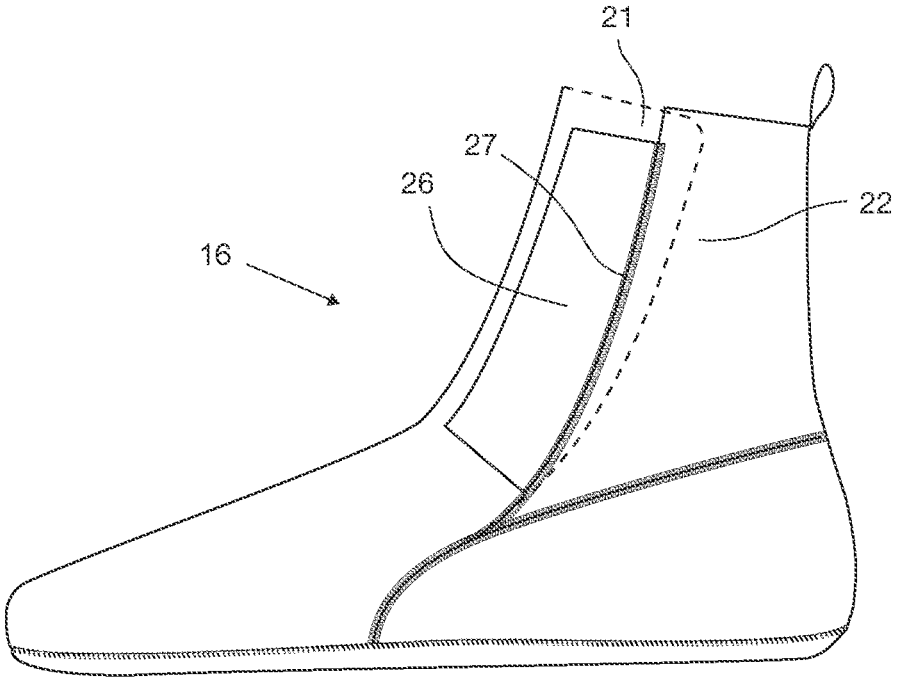
FIG. 6B illustrates a side view of the boot of FIG. 6B.

FIGS. 6A and 6B illustrate top view and a side view, respectively, of the upper 16 of embodiment shown in FIGS. 2A, 2B, 3A and 3B with rubber layers 30, 33, outsole 44, ankle strap 34 and lacing system hidden. In addition, front segment 21 has been shown in dashed line to detail gusset 26 below (or under) said front segment 21. While the gusset 26 is shown as extending along only a portion of the attachment edge 27, the gusset 26 may be adapted to extend up the entire length of the attachment edge 27.

In one embodiment, a boot 1 may be suitable for small boat dinghy sailing and windsurfing. The application for these watersports is provided as the boot 1 provides for a high level of dexterity. In addition, the boot 1 may provide for improved sensitivity relative to known boots, is relatively lightweight, and can provide support to muscle groups in the foot or ankle or legs of the user. As such, the boot 1 may be particularly attractive for a wide range of sailing styles, from windsurfing to hiking dinghys, and including dinghys which utilise trapeze systems.

In another embodiment, the boot 1 may be suited to yachting. It is possible to design versions of the boot 1 for yachting, in various weights and sole designs. This may also include ankle cut sailing shoes using the same or similar lacing system 15 as illustrated. It will be appreciated that the lacing system 15 may be swapped to be on either the inner 2 or outer side 3 of the boot 1 for specific sports.

In a further embodiment, the boot 1 may be suitable for various watersports. For example, the boot 1 may be used for at least one of; diving, skiing, surfing, fishing, canoeing, and rowing.

Preferably, the boot 1 is formed with between three (3) to ten (10) anchor points or tensioning points 24, 25. As shown, there are 6 tension points provided which allow for a desired tightness to be imparted to the boot 1. The length of the tensioning points 24, 25 may be extended to disperse the load imparted when tightening the lace 23 and improve comfort.

The lace system 15 as shown has a hash type structure which crosses the lace 23 between tensioning points 24, 25 on the front segment 21 and the rear segment 22, respectively. Crossing the lace 23 between the tensioning points allows for the lace 23 to draw tensioning points 24 of the front segment 21 towards the tensioning points 25 of the rear segment 22. Collectively, the lace system 15 comprises a plurality of tensioning points 24, 25 and a lace 23 mounted with said tensioning points 24, 25.

Having fewer tensioning points 24, 25 relative to known boots also allows for faster and easier lacing of the lacing system 15 in use. This is primarily due to each tensioning point 24, 25 allowing for movement of a lace 23 therein to be brought to a desired tension with less resistance due to the lower number of tensioning points 24, 25. Optionally, the laces 23 are generally spaced on the boot such that the laces do not traverse over the peak of the lateral malleolus (outer ankle bone) of the wearer in use, which can also improve the comfort of the boot 1. The lacing system 15 can be disposed on an outer side of the upper 16 and configured such that the lace 23 of the system crosses over itself fewer than six times between anchor points in the closed configuration. Optionally, the lace 23 of the system crosses over itself fewer than seven times, fewer than six times, fewer than four times, or fewer than three times, or fewer than two times, or any other predetermined number of times.

The boot 1 may provide for a reduction in the amount of lace 23 required to configure a boot 1 in a closed configuration, relative to known boot lace systems 10. In addition, as the length of the lace 23 has also been reduced, the speed in which the lace system 15 can be fastened can be reduced relative to known systems, while also reducing the overall amount of materials required to manufacture the boot 1.

The angle of the strap 34 improves comfort of the user and conform more to user anatomy. The angle of the strap relative to the ground may be at an angle of between −10° to −30° from the horizontal plane (or 10° to 30° relatively downwardly). The angle of the strap can be adjusted for comfort by fixing the strap at a desired orientation.

Strap guides 36 may be disposed on the upper 16 of the boot 1, and are preferably formed on the rear segment 22, but also may be formed on the front segment 21. The guides 36 may be formed by beads or protrusions which assist with reducing movement of the ankle strap 34 when in use. Guides 36 may be formed as part of an armour or rubber layer 30 on the exterior of the boot 1. It is preferred that the height of the guides 36 is approximately the same as, or greater than, the thickness of the strap 36.

Using a cord lock 29 allows for the lace system 15 to be locked in a desired configuration. Any excess lace 23 which is not required to retain the boot 1 in a desired configuration can be releasably retained by the cord lock 29 or retained between the outer segment 21 and the inner segment and/or the gusset 26, or tucked into the opening after the boot 1 has been tightened. Optionally, the strap 34 may have a pocket or pouch which can receive a portion of the lace 23, and after the lace 23 has been tightened.

Elastic filaments in the lace 23 may allow for a desired stretch of the lace 23 in use. Having an elasticised lace 23 may also allow for improved comfort when a user rotates their ankle or pivots their foot.

As illustrated, the lace system 15 can be disposed on the outer side of the boot, such that the lace system 15 is provided near to the lateral malleolus (ankle bone) of the wearer. Preferably, both sides of the ankle have a flexible and/or soft material over the ankle bones of the foot such that increased comfort may be provided to the wearer. For example, the ankle bone regions of the boot may be generally free from rubber, reinforcement material or a protective layer. The lace system 15 of the boot 1 may provide for a higher degree of flexibility for the user when using a wider stance. While it is preferred that the laces 23 of a pair of boots 1 be on the outside for some applications, the lace system 15 may alternatively be provided on the inner side 2 of the boot 1 such that the inner ankle of the wearer is adjacent to the lace system 15. Having the lace system 15 on the inner side 2 may protect the laces 23 from becoming hooked or interfered with which could pose a danger for some watersport applications.

At least one embodiment of the boot 1 of the present disclosure provides for a novel watersports boot featuring a side lace system 15 utilising an overlapping upper and optional gusset 26. The side lacing system 15 allows a wide opening to be formed to improve the ease of donning and doffing the boot 1, has a wide tightening range of the lace system 15 to provide a close fit around the foot and ankle and also offers improved comfort and ease of use of the lacing system 15 and improved efficiency in production.

The watersports boot 1 comprises an upper that is provided with a gap or split which extends from the opening down a side of the boot 1 which separates a front segment and rear segment of the upper 16 on one side of the boot 1. A lacing system 15 is provided on the upper 16 that connects either side of the split via tensioning points 24, 25 that pull the front segment 21 towards the rear segment 22 of the upper 16, thereby reducing the volume of the boot 1. Reducing the volume of the boot can assist with securing the boot 1 around the foot and/or ankle of a user.

The gusset 26 is fixed to the rear segment 22 at at least two locations. The remaining portion of the upper 16 defines the front segment 21. As can be seen from FIGS. 3A and 3B, the front segment 21 is fixed to the rear segment 22 at the inner side of the boot 1.

In a preferred embodiment, the boot 1 features a gusset 26 that connects the front segment 21 and/or the rear segment 22 of the upper 16. The gusset 26 can be provided to form the opening with rear segment 22, and can be used to hold around or about the ankle of a user before tightening of the lace system 15 and/or the strap 34. The stretchable gusset 26 also assists in the positioning of the upper 16 on a last during manufacturing without the use of the lace 23 thereby reducing time required to fit the upper 16 on a last and improving consistency and quality during production. Said stretchable gusset 26 is configured so that it sits flat or substantially flush and is resistant to wrinkling or overlap when the boot 1 is in its tightest position, the elongation ability of the gusset 26 and width is configured to allow the boot 1 to be opened to a circumference that is adequate to allow easy donning and doffing of the boot 1.

In a preferred embodiment, the boot 1 comprises an ankle strap 34 comprising a hook and loop fastener or other fastening means to further secure the boot opening 19. The strap 34 may be formed with one end fixed to the front segment 21, which is of a relatively larger length than the free end of the strap 34.

In a further embodiment, the boot 1 includes a rubber or other material grip panel on the front segment of the upper 16 in order for the boot 1 to grip with hiking straps.

In yet another embodiment, the boot 1 has a textured rubber sole to provide a suitable grip on wet surfaces.

The boot 1 has a sole 42, a vamp 18, and an upper 16. The upper 16 may be formed as a shaft which extends above or around the ankle of a wearer in use. The upper 16 may include a split 20 which extends generally axially down the upper 16, and separates a front segment 21 and a rear segment 22 of the upper 16. The split 20 may also be formed to generally follow the anatomical contour of the foot of a user when worn. For example, the split 20 may extend along the ankle, and along a portion of the talus or bridge of the foot. An expandable gusset 26 can be provided at the split 20 between the front segment 21 and the rear segment 22.

The gusset 26 can be fixed to the rear segment 22 at at least two locations (see FIG. 3A). The remaining portion of the upper 16 on the toe side of the gusset 26 defines the front segment 21. As can be seen from the embodiments of FIGS. 3A and 3B, the front segment 21 is fixed at one end to the rear segment 22, and the region 28 other end of the front segment 21 is a free end. The free end of the front segment 21 may define a flap which can move relative to the gusset 26, this is to say the free end is displaceable relative to the gusset 26. The front segment 21 can be fixed with strap 34 and pulling the strap 34 can be used to assist with tightening the front segment 21 around the foot or ankle of the user, and forming the closed configuration. The gusset 26 may be formed as a band or strip extending from one end of the rear segment 22 to the second end of the rear segment 22. The gusset 26 may be attached to a portion of the edge of the rear segment 22 or the entire edge of the rear segment 22.

Figure 4A:
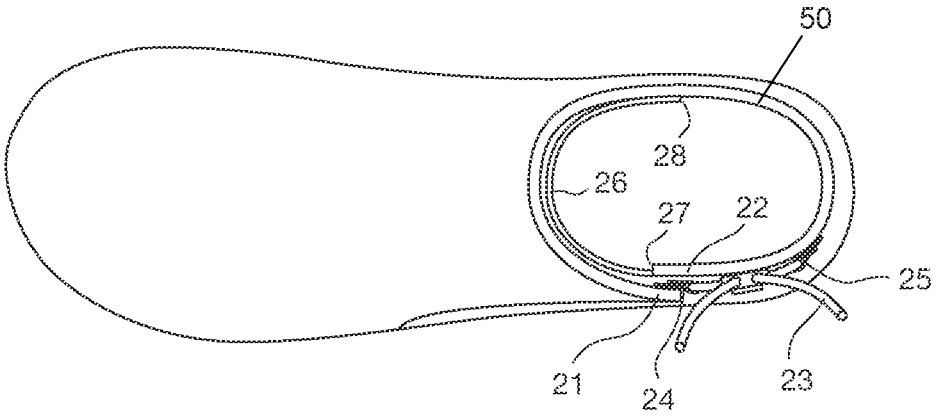
FIG. 4A illustrates a top view of an embodiment of a boot without a strap or outer rubber layers fixed to said boot.
Figure 4B:
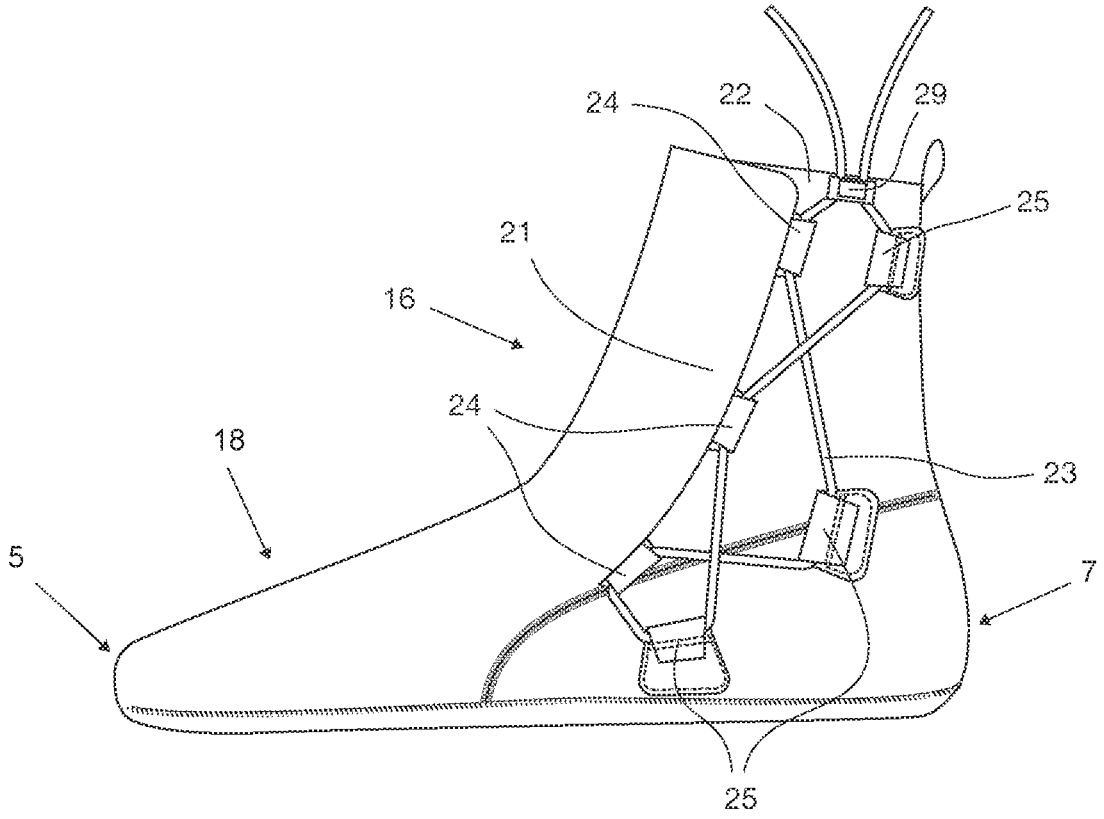
FIG. 4B illustrates a side view of the embodiment of FIG. 4A.
Figure 5A:
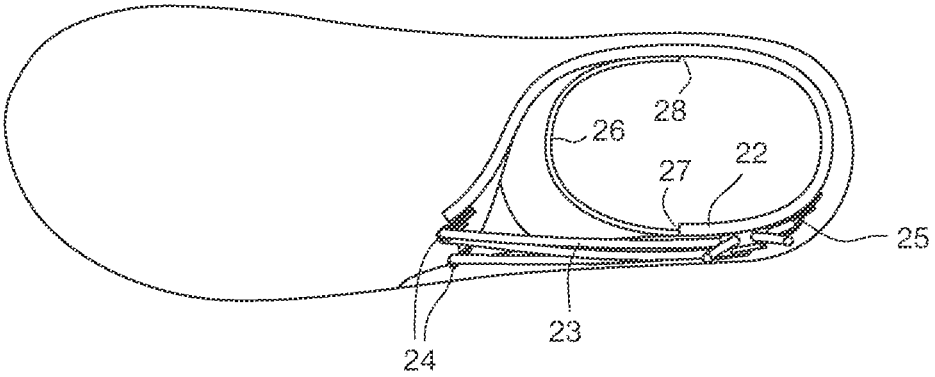
FIG. 5A illustrates a top view of an embodiment of the boot of FIG. 4A, in which the boot is in the open configuration.
Figure 5B:
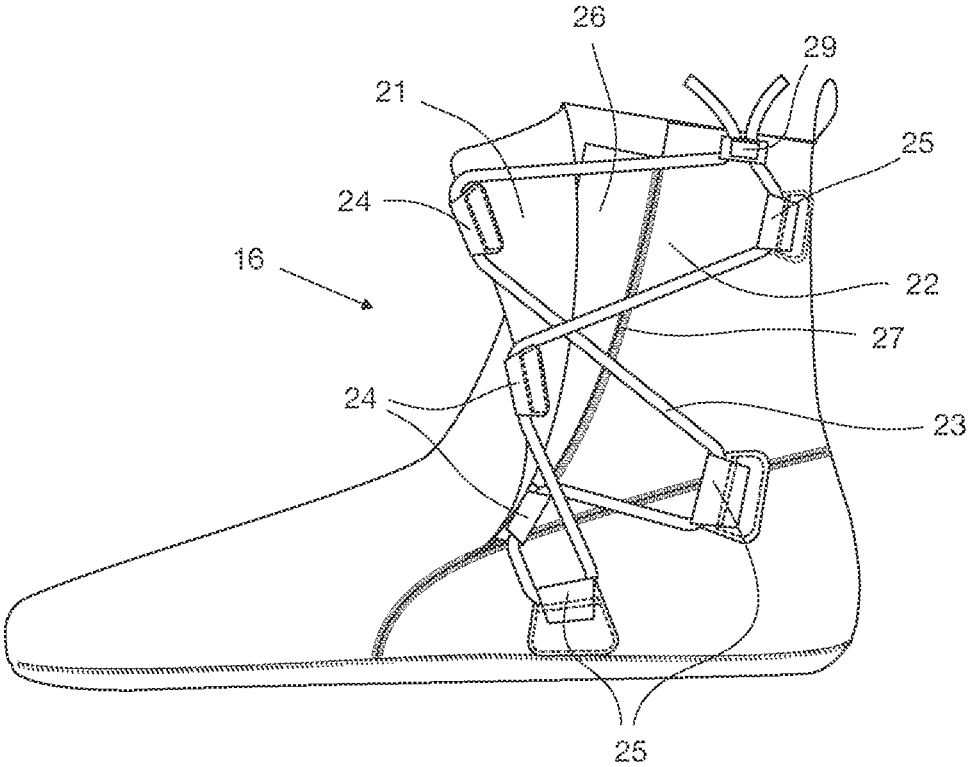
FIG. 5B illustrates a side view of an embodiment of the boot of FIG. 4B.

The front segment 21 of the upper 16 is preferably fitted with tensioning points 24 which can receive a lace 23. Each tensioning point 24 can be spaced along a length of the free end of the front portion 21. Alternatively, the tensioning points 24 can be provided near to the free end of the front segment 21. Corresponding tensioning points 25 are disposed on the rear segment 22 and also receive the lace 23, such that pulling the lace 23 reduces the relative distance between the series of tensioning points 24 disposed on the front segment 21 and the series of corresponding tensioning points 25 on the rear segment 22. In another embodiment, the tensioning points 24, 25 of the lace system 15 are disposed such that the exit angle imparted by a respective tensioning point 24, 25 to the lace 23 is at least 90 degrees relative to the entry point angle of the lace 23 for at least 50% of the tensioning points 24, 25. It will also be appreciated that each tensioning point 24, 25 may be sized differently to distribute a load in a desired manner. As seen in FIGS. 4B and 5B, the tensioning points 25 near to the sole 42 and heel 7 of the boot 1 are relatively larger than that of tensioning points 24 on the front segment 21.

It will be appreciated that the boot may have any number of tensioning points 24, 25 along the length of the split 20 to allow for a desired lacing structure. If the lace system 15 of the boot 1 comprises a higher number of tensioning points 24, 25 (than is shown in the Figures) the more narrow the angle formed between the entry point and the exit point of the lace 23 in the system 15. Therefore, the angles formed by the laces may be less than 90° and are preferably in the range of 30° to 70°. Having more tensioning points may provide for a more secure fitting around the foot of the wearer. Optionally, a further tightening means or securing means may be provided on the other side of the upper relative to the lace system 15.

The vamp 18 may have a top box or a flexible toe tip near at the toe 7, depending on the final application of the boot 1. A reinforced toe tip or toe box at the toe end 5 may be provided to protect the toes of the wearer during use or provide additional comfort padding. Similarly, a heel cup can be provided to reinforce the heel region of the boot 1. Toe boxes and heel caps may be types of armour or reinforcing which may be formed internal the material forming the boot 1, or may be disposed on the surface of the boot 1. The reinforcement may be a fibrous polymeric structure, a corrosion resistant metal, a metal which is covered with a corrosion resistant material, or may be any other structure which can reduce the potential of injury from an impact on the boot 1.

If the boot 1 does not include a reinforced structure is provided, a thicker material or multiple layers of material may be provided at the toe tip, which may also have the added benefit of reducing wear out of the toe tip. The top surface of the vamp 18 may be provided with a textured surface. The textured surface may be fixed, adhered, bonded or otherwise mounted on the top surface of the vamp 18. The textured surface 32 may be formed with a predetermined texture which is adapted to mate with a sailing strap, or may be used as a high friction surface. The vamp 18 may be formed with more than one surface material and may be formed from a plurality of materials. Each layer 30 or surface of the vamp 18 may be stitched together, glued together, bonded together, taped together, melted to form the surface or otherwise fixed together by conventional means. The vamp 18 is connected to the upper 16 of the boot 1, and preferably, the vamp 18 and upper are formed from the same material. The material forming the vamp 18 and the upper 16 may be continuous as is shown in FIGS. 2A to 6B.

The sole 42 of the boot 1 may be formed with a polymeric or rubber outsole 44. The midsole 46 can be formed from the same material as the outsole 44, and preferably comprises a structure which allows for cushioning or padding to improve comfort. Cushioning or padding may be provided by a partially hollow structure, or may be provided by a cushioning material. The insole 48 of the boot 1 can be provided with a cushion material to improve comfort of the wearer. Optionally, the insole can be fixed with the midsole 46 or can be removable. Collectively, the sole 42 comprises an outsole 44, midsole 46 and insole 48. Optionally, the outsole 44 and/or midsole 46 and/or insole 48 can be formed as an integral piece. A protective coating can be applied to at least one of the outsole 44, midsole 46 and insole 48.

Optionally, the sole 42 may be formed with an arch (not shown) to provide a desired flexibility to the boot 1. The arch may also be used to impart a desired support structure to the boot 1 to assist with user comfort.

The upper 16 as shown in FIGS. 2A to 3B comprise a strap 34. The strap 34 can be wrapped around the upper 16 of the boot 1 to improve the fit between the ankle of the wearer and the boot 1. Guides 36 (shown in FIGS. 2B and 3B) may be disposed on the outer surface of the upper 16 and are used to restrict movement of the strap 34 in use, and also to assist with correct strap placement for optimal support. The strap 34 of FIG. 2B is shown angled, which is an improvement over the straps of the prior art boot illustrated in FIGS. 1A to 1D. Having an angled strap 34 allows for improved mobility and comfort while wearing the boot as the strap 34 conforms more to the natural shape of the wearer. Preferably, the strap 34 is angled downward from the toe side of the upper 16 to the heel side of the upper 16, as is shown in FIG. 2B.

The distal end 35 of the strap 34 is the end of the strap which can be freed from connection with the boot 1. The strap 34 can be secured at a desired tightness around the upper 16 of the boot 1 by using a mating means, such as a hook and loop fastener, a buckle, a button, a friction surface, press stud, adhesive, bonding surface or any other desired releasable mating means. It is preferred that the distal end of the strap 34 comprising a mating means on an inner surface which is adapted to connect to a corresponding mating means on the outer surface 34' of the strap. The outer surface 34' of the strap 34 can be seen in FIG. 2B and the inner surface 34" of the strap can be seen in FIG. 3B. The strap 34 may be of a length sufficient to extend the circumference (or more generally the perimeter) of the upper 16 and may be adapted to mate to itself.

The strap 34 may be formed from an open cell composite or closed cell composite, or a combination thereof, Preferably, the materials is selected from the group of; polyurethane, EVA, neoprene, styrene butadiene or foams thereof. Optionally, one or both sides of the material are laminated and include a knitted or woven textile comprising natural or synthetic yarns.

The lace system 15 of the boot 1 may be formed with any predetermined number of tensioning points 24, 25. Tensioning points 24 are disposed on the outer segment 21, and the corresponding tensioning points 25 may be disposed on the heel cup of the upper or between the heel cap and heel end 7 of the upper 16 (as seen in FIG. 2B).

The upper 16 may be formed with a cut-away portion or formed with a split 20 near to the ankle of the wearer. The upper 16 may have a front segment (nearest to the top end 5) and a rear segment (nearest to the heel side 7).

Referring FIGS. 4B and 5B, there is illustrated the boot of FIGS. 2A to 3B in which the armour, outsole and textures have been removed to more clearly see the upper 16 of the boot and attachment locations of the tensioning points 24, 25. Tensioning points 24, 25 can be stitched, glued, bonded, welded, or otherwise fixed to the upper 16 or segments 21, 22 thereof.

Optionally, the vamp 18 and the upper 16 can be covered, or partially covered, with a coating such as layers 30, 32. The coating can be at least one of a rubber coating, a polymer coating, and a functional coating, textured surfaces may be formed with protrusions. The protrusions may be formed with any desired shape, may it is preferred that the boot is formed with a shape which is suitable to mate with a predetermined, or a generic, hiking strap.

Optionally, a lining may be provided on the inside of the boot 1. The lining may be provided to improve comfort to the user or may be used to prevent damage to a material of the boot 1. For example, if the boot 1 is formed from a closed cell foam, it may be advantageous to protect the foam from abrasion or impact to improve the expected life of the closed cell foam.

Referring to FIGS. 6A and 6B, there is illustrated an embodiment of a boot 1 without a lace system 15 as shown in FIGS. 4A to 5B. The front segment 21 of the boot is illustrated as a dashed line which is adapted to overlap the gusset 26, and at least a portion of the rear segment 22. It will be appreciated that the amount of overlap of the gusset and/or the rear segment 22 may be dependent on the size of the ankle of the user.

Optionally, the upper 16 is further provided with a pull strap 40 to assist with donning the boot 1. Pull strap 40 can be made from a generally non-elastic material, and may be a web of fibres or yarns which can assist with applying a tension to the upper 16. The pull strap 40 can be formed with a size that may be sufficient to allow a user to insert a finger to impart a tension to the pull strap 40. The pull strap 40 may be in the form of a jug loop 40 and fixed to the rear segment 22.

Armour or abrasion resistant coatings or layers 30 may be provided to the exterior of the boot 1, which can assist with reducing the potential for the boots 1 to be cut on rocks, shells, glass, or other common seashore or beach materials. These layers or coatings may be used to provide a greater level of protection to the wearer. Armour can be provided to any portion of the boot 1, but will have particular use on the sole, at the heel, and at the toe of the boot 1 as these areas will likely receive the majority of abrasion during use.

A boot 1 may be any article of footwear covering the foot and ankle, and optionally also a portion of the lower leg. While the present disclosure is primarily directed towards a boot 1, other articles of footwear may also be anticipated by the present disclosure, such as a shoe, toe shoe, or any other article of footwear which generally covers the entirety of a foot of a wearer.

In another embodiment, the boot 1 is provided without a lace system 15. To tighten the boot 1 of this embodiment around the ankle of a user the upper 16 is formed with a stretchable gusset 26 which can expand to allow insertion or removal of a foot of the user. Optionally, this embodiment may also comprise a strap 34 (not shown) to assist with forming a tight and comfortable closed configuration around the ankle of a user. Optionally, more than one gusset 26 may be provided on a boot 1 to give the boot a desired stretchability without exceeding an elastic limit of the gussets 26. In an at rest position, the boot 1 may be in a closed configuration, and stretching of the gusset 26 can move the boot 1 into an open configuration.

In another embodiment, the gusset 26 is an adjustable flap which can be secured at a desired location on the inner surface 28 of the boot upper 16. The gusset 26 may be released from the desired location to allow for insertion of a foot of a user into the boot 1 or the gusset 26 may be stretchable.

Although the invention has been described with reference to specific examples, it will be appreciated by those skilled in the art that the invention may be embodied in many other forms, in keeping with the broad principles and the spirit of the invention described herein.

The present invention and the described preferred embodiments specifically include at least one feature that is industrial applicable.

The invention claimed is:

1. A footwear article for watersports comprising;

a sole, a vamp in connection with the sole and an upper fixed with the vamp and the sole;

a lacing system disposed on the upper, the lacing system comprises a lace, a first set of anchor points and a second set of anchor points;

said lacing system is disposed on an outer side of the upper and configured such that the lace crosses over itself fewer than six times between anchor points in the closed configuration;

at least one of the vamp and the upper comprises a textured surface, and an upper comprises a strap adapted to extend around at least the outer side and an inner side of the upper;

the upper is formed with a first protrusion and a second protrusion adapted to form a strap guide, in which at least one of the first protrusion and the second protrusion is a bead, such that the strap guide is adapted to restrict movement of the strap in a direction parallel to the upper while allowing the strap to be free of the strap guide perpendicular to the upper; and wherein the first protrusion is positioned on the front of the upper and the second protrusion is formed on the rear of the upper, each of the first protrusion and second protrusion being positioned above a midway point between the sole and the top edge of the upper, such that the lace system is positioned between the first and second protrusions.

2. The footwear article as claimed in claim 1, wherein the upper is integrally formed with the vamp.

3. The footwear article as claimed in claim 1, wherein the textured surface comprises a plurality of protrusions and is adapted to mate with a hiking strap.

4. The footwear article as claimed in claim 1, wherein the sole comprises at least one of; an outsole, a midsole and an insole.

5. The footwear article as claimed in claim 1, wherein at least one rubber layer is fixed to at least one of the vamp and the upper.

6. The footwear article as claimed in claim 1, wherein the strap comprises a lock such that the strap can be secured around the outer side and an inner side of the upper.

7. The footwear article as claimed in claim 1, wherein the article is formed in part with at least one material selected from the following group; an open cell composite, a closed cell composite, a foam, a rubber and a combination of one of the preceding materials.

8. The footwear article as claimed in claim 1, wherein at least one of the first protrusion and the second protrusion is an elongate bead which extends at least partly around the upper.

9. The footwear article as claimed in claim 1, wherein the protrusion is of a thickness which is equal to or greater than the thickness of the strap.

10. The footwear article as claimed in claim 1, wherein the strap guide comprises two protrusions on the rear of the upper which bound the strap therebetween.

11. The footwear article as claimed in claim 1, wherein the at least one protrusion is disposed generally parallel to the orientation of the strap.

12. The footwear article as claimed in claim 1, wherein at least one of the first set of anchor points and a second set of anchor points includes an anchor point which is a loop in the form a folded material and fixed to the upper.

13. The footwear article as claimed in claim 1, wherein an upper strap edge is in contact with both the first protrusion and the second protrusion of the strap guide.

14. The footwear article as claimed in claim 6, wherein the strap extends over the lacing system on the outer side towards the rear of the boot before extending over the inner side of the upper, and being fixable to the securing means.

15. A footwear article comprising;

a sole connected to an upper forming a boot;

the upper defining an opening into a cavity of the boot for receiving a foot of a user;

a top surface of the boot comprising a textured surface;

a strap is mounted on the upper, in which the strap is adapted to extend around at least the perimeter of the upper;

the upper is formed with a first protrusion and a second protrusion adapted to form a strap guide, in which at least one of the first protrusion and the second protrusion is a bead, such that the strap guide is adapted to restrict movement of the strap in a direction parallel to the upper while allowing the strap to be free of the strap guide perpendicular to the upper; and wherein the first protrusion is positioned on the front of the upper and the second protrusion is formed on the rear of the upper such that a lace system is positioned between the first and second protrusions, in which the lace system is disposed on the outer side of the boot.

16. The footwear article as claimed in claim 15, wherein the opening of the upper can be expanded to receive said foot of the user.

17. The footwear article as claimed in claim 15, wherein when the strap is wrapped around the upper the strap extends over the lace system on the outer side of the boot and around the rear of the boot and inner side of the boot and is fixable to at least one of itself and an attachment point on the boot.

18. The footwear article as claimed in claim 15, wherein the lace system comprises a lace formed from at least one elastomeric fiber.

19. The footwear article as claimed in claim 15, wherein the lace system comprises a first set of tensioning points on a first segment of the upper, and a second set of tensioning points on a second segment of the upper.

20. The footwear article as claimed claim 15, wherein the upper is covered at least in part with a rubber layer.

21. The footwear article as claimed in claim 15, wherein the strap guide comprises a protrusion adapted to reduce movement of the strap in a direction perpendicular to a longitudinal edge of said strap.

* * * * *